US005760692A

United States Patent [19]

Block

[11] Patent Number: 5,760,692

[45] Date of Patent: Jun. 2, 1998

[54] INTRA-ORAL TRACKING DEVICE

[76] Inventor: Douglas A. Block, 69 Sandpiper Dr., Manalapan, N.J. 07726

[21] Appl. No.: 730,906

[22] Filed: Oct. 18, 1996

[51] Int. Cl.[6] ..... G08B 23/00

[52] U.S. Cl. ..... 340/573; 340/505; 340/539; 340/693; 455/575

[58] Field of Search ..... 340/573, 572, 340/539, 505, 825.54, 825.49, 825.19, 693; 455/100, 351, 575

[56] References Cited

U.S. PATENT DOCUMENTS

| | | | |
|---|---|---|---|
| 3,297,021 | 1/1967 | Davis et al. | 455/100 X |
| 3,985,977 | 10/1976 | Beaty et al. | 455/351 X |
| 4,706,689 | 11/1987 | Man | 340/539 X |
| 5,523,745 | 6/1996 | Fortune et al. | 340/825.19 |
| 5,629,678 | 5/1997 | Gargano et al. | 340/573 |

*Primary Examiner*—Thomas Mullen

[57] ABSTRACT

An intra-oral tracking device adapted for use in association with a tooth having a buccal surface and a lingual surface, the apparatus comprises a tooth mounting member having an inner surface and an outer surface, the inner surface including adhesive material; a remote transmitter-receiver assembly including means to transmit and receive electronic signals, the transmitter-receiver being affixed to the outer surface of the tooth mounting member, the remote transmitter-receiver assembly positioned adjacent to the buccal surface of the tooth; and a base transmitter-receiver device including means to transmit and receive electronic signals, the device including a transmission button and a display screen, in an operative orientation a user depressing the transmission button of the base transmitter-receiver device to activate the remote transmitter-receiver, activation of the remote transmitter-receiver device causing the transmission of electrical signals for receipt by the base transmitter-receiver device, the base transmitter-receiver device thereby displaying the location of the remote transmitter-receiver assembly to enable a user to locate a lost individual.

7 Claims, 4 Drawing Sheets

FIG. 5
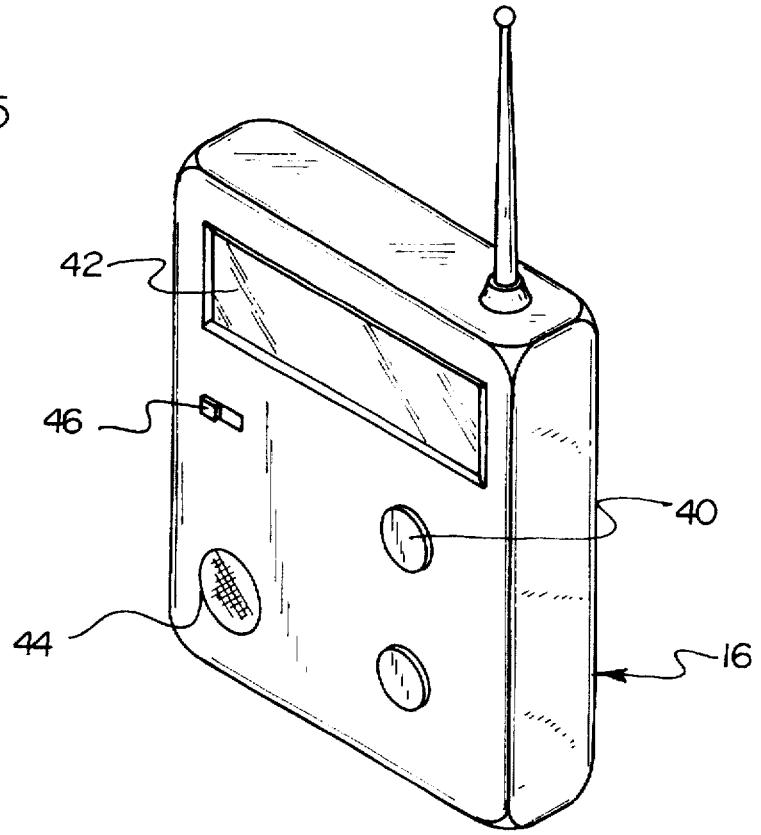
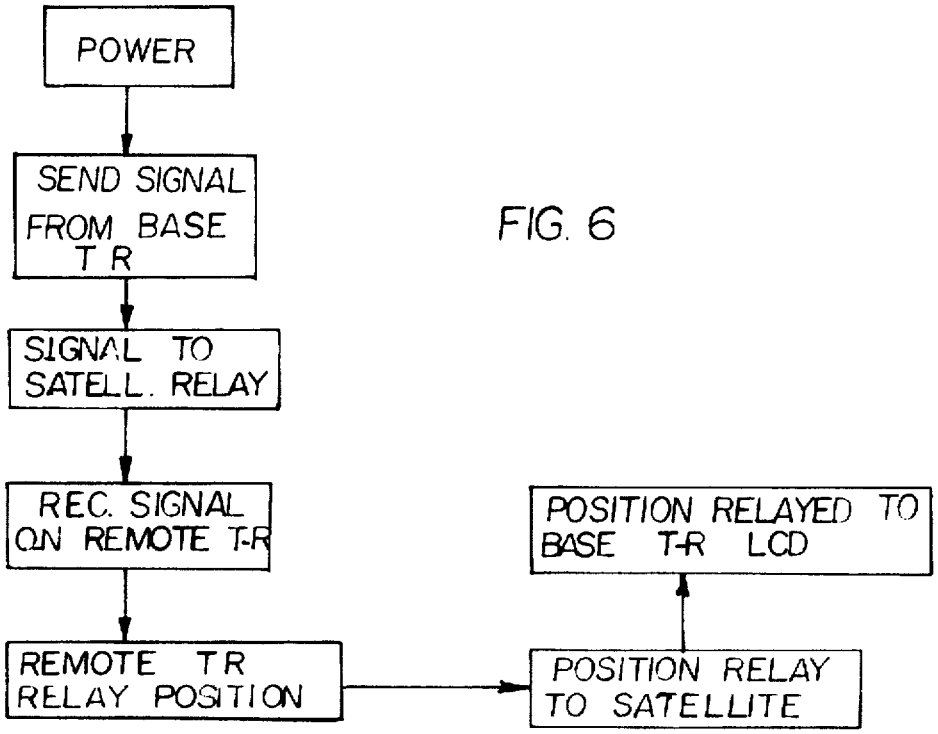
FIG. 6

INTRA-ORAL TRACKING DEVICE

BACKGROUND OF THE INVENTION

1. Field of the Invention

The present invention relates to an intra-oral tracking device and more particularly pertains to locating a lost individual by activating the apparatus.

2. Description of the Prior Art

The use of locator devices is known in the prior art. More specifically, locator devices heretofore devised and utilized for the purpose of locating lost individuals or articles are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,014,040 to Weaver et al. discloses a personal locator transmitter.

U.S. Pat. No. 5,021,794 to Lawrence dicloses a personal emergency locator system.

U.S. Pat. No. 5,119,072 to Hemingway discloses an apparatus for monitoring child activity.

U.S. Pat. No. 4,899,135 to Ghahariiran discloses a child monitoring device.

U.S. Pat. No. 4,888,580 to Distel discloses a child protector.

U.S. Pat. No. 5,121,096 to Moore et al. discloses a position locating device.

U.S. Pat. No. 5,245,314 to Kah, Jr. discloses a location monitoring system.

U.S. Pat. No. 5,289,163 to Perez et al. discloses a child position monitoring and locating device.

U.S. Pat. No. 5,337,041 to Friedman discloses a personal safety guard system for stray person or pet.

While these devices fulfill their respective, particular objective and requirements, the aforementioned patents do not describe an intra-oral tracking device for locating a lost individual by activating the apparatus.

In this respect, the intra-oral tracking device according to the present invention substantially departs from the conventional concepts and designs of the prior art, and in doing so provides an apparatus primarily developed for the purpose of locating a lost individual by activating the apparatus.

Therefore, it can be appreciated that there exists a continuing need for new and improved intra-oral tracking device which can be used for locating a lost individual by activating the apparatus. In this regard, the present invention substantially fulfills this need.

SUMMARY OF THE INVENTION

In the view of the foregoing disadvantages inherent in the known types of locator devices now present in the prior art, the present invention provides an improved intra-oral tracking device. As such, the general purpose of the present invention, which will be described subsequently in greater detail, is to provide a new and improved intra-oral tracking device and method which has all the advantages of the prior art and none of the disadvantages.

To attain this, the present invention essentially comprises a new and improved intra-oral tracking device adapted for use in association with a tooth having a buccal surface and a lingual surface, the apparatus comprising, in combination: an orthodontic band fabricated of non-precious crown and bridge alloy, the orthodontic band being formed in a ring shaped configuration with an inner surface and an outer surface, the inner surface including adhesive material; a remote transmitter-receiver assembly including an outer casing, a transmitter-receiver unit and a power source, the outer casing being formed in a hollow generally rectangular configuration, the transmitter-receiver unit and power source being operatively coupled to each other and positioned within the outer casing, the transmitter-receiver unit including means to transmit and receive electronic signals, the outer casing being affixed to the outer surface of the orthodontic band, in an operative orientation the orthodontic band being coupled around a tooth with the remote transmitter-receiver assembly positioned adjacent to the buccal surface of the tooth; and a base transmitter-receiver device formed in a generally rectangular configuration and including means to transmit and receive electronic signals, the device including a power source, a transmission button, a liquid crystal display screen, a speaker and an on/off power switch, in an operative orientation a user depressing the transmission button of the base transmitter-receiver device to activate the remote transmitter-receiver assembly, activation of the remote transmitter-receiver device causing the transmission of electrical signals for receipt by the base transmitter-receiver device, the base transmitter-receiver device thereby displaying the location of the remote transmitter-receiver assembly to enable an adult user to locate a lost individual.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved intra-oral tracking device which has all the advantages of the prior art locator devices and none of the disadvantages.

It is another object of the present invention to provide a new and improved intra-oral tracking device which may be easily and efficiently manufactured and marketed.

It is a further object of the present invention to provide a new and improved intra-oral tracking device which is of durable and reliable construction.

An even further object of the present invention is to provide a new and improved intra-oral tracking device which is susceptible of a low cost of manufacture with regard to both materials and labor, and which accordingly is then susceptible of low prices of sale to the consuming public, thereby making such an intra-oral tracking device economically available to the buying public.

Still yet another object of the present invention is to provide a new and improved intra-oral tracking device which provides in the apparatuses and methods of the prior art some of the advantages thereof, while simultaneously overcoming some of the disadvantages normally associated therewith.

Even still another object of the present invention is to provide a new and improved intra-oral tracking device for locating a lost individual by activating the apparatus.

Lastly, it is an object of the present invention to provide a new and improved intra-oral tracking device adapted for use in association with a tooth having a buccal surface and a lingual surface, the apparatus comprises a tooth mounting member having an inner surface and an outer surface, the inner surface including adhesive material; a remote transmitter-receiver assembly including means to transmit and receive electronic signals, the transmitter-receiver being affixed to the outer surface of the tooth mounting member, the remote transmitter-receiver assembly positioned adjacent to the buccal surface of the tooth; and a base transmitter-receiver device including means to transmit and receive electronic signals, the device including a transmission button and a display screen, in an operative orientation a user depressing the transmission button of the base transmitter-receiver device to activate the remote transmitter-receiver, activation of the remote transmitter-receiver device causing the transmission of electrical signals for receipt by the base transmitter-receiver device, the base transmitter-receiver device thereby displaying the location of the remote transmitter-receiver assembly to enable a user to locate a lost individual.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an isolated perspective view of the base transmitter-receiver device.

FIG. 6 is a flowchart summarizing the flow of electronic information when utilizing the apparatus.

The same reference numerals refer to the same parts through the various Figures.

DESCRIPTION OF THE PREFERRED EMBODIMENT

Figure 1:
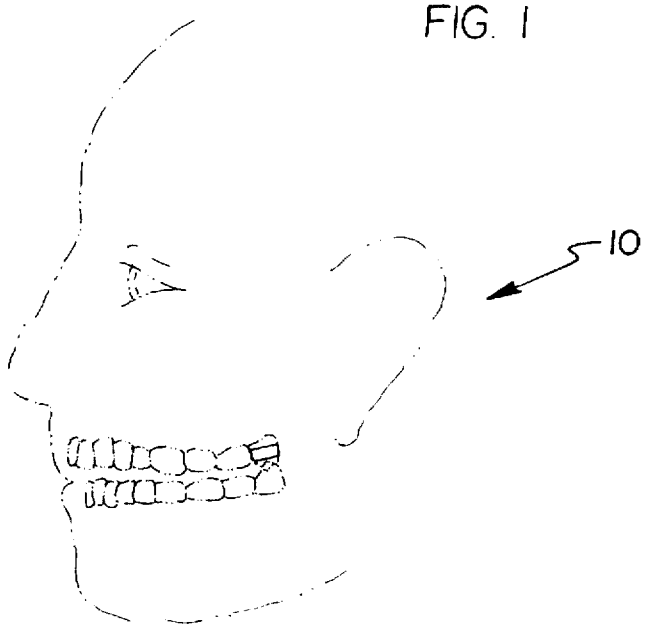
FIG. 1 is a perspective view of the preferred embodiment of the intra-oral tracking device constructed in accordance with the principles of the present invention.

With reference now to the drawings, and in particular, to FIG. 1 thereof, the preferred embodiment of the new and improved intra-oral tracking device embodying the principles and concepts of the present invention and generally designated by the reference number 10 will be described.

Specifically, it will be noted in the various Figures that the device relates to an intra-oral tracking device. In its broadest context, the device consists of an orthodontic band 12, a remote transmitter-receiver assembly 14 and a base transmitter-receiver device 16. Such components are individually configured and correlated with respect to each other so as to attain the desired objective.

Figure 2:
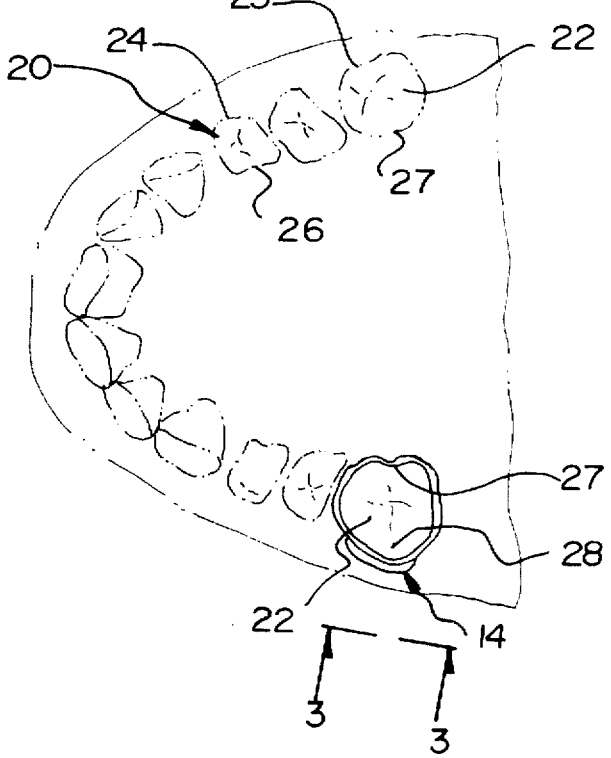
FIG. 2 is a perspective view of a child's teeth.

The intra-oral tracking device 10 is adapted for use in association with a child or adult's tooth. When utilized with children, the apparatus is preferably coupled to the child's permanent molar tooth 22. The apparatus can also be coupled to a child's deciduous non-molar tooth 20 if the child is below the age of six. The apparatus would then be changed with the eruption of the permanent molar. Each of the child's non-molar teeth 20 and molar teeth 22 have a buccal surface 24, 25 located adjacent to the cheek, and a lingual surface 26, 27 located adjacent to the child's tongue. The apparatus is very beneficial in locating people with physical and mental disabilities. Note FIG. 2.

Figure 4:
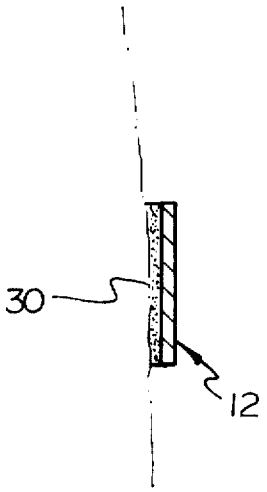
FIG. 4 is a side perspective view taken along section line 4—4 of FIG. 3 illustrating the apparatus coupled to a molar tooth.

The orthodontic band 12 is fabricated of non-precious crown and bridge alloy. The band is formed in a ring shaped configuration with an inner surface and an outer surface 28. The inner surface includes adhesive material 30 to permit secure coupling around a child's tooth. In attaching the band to a tooth it should first be microetched to allow adherence of the adhesive. Note FIGS. 2 and 4.

Figure 3:
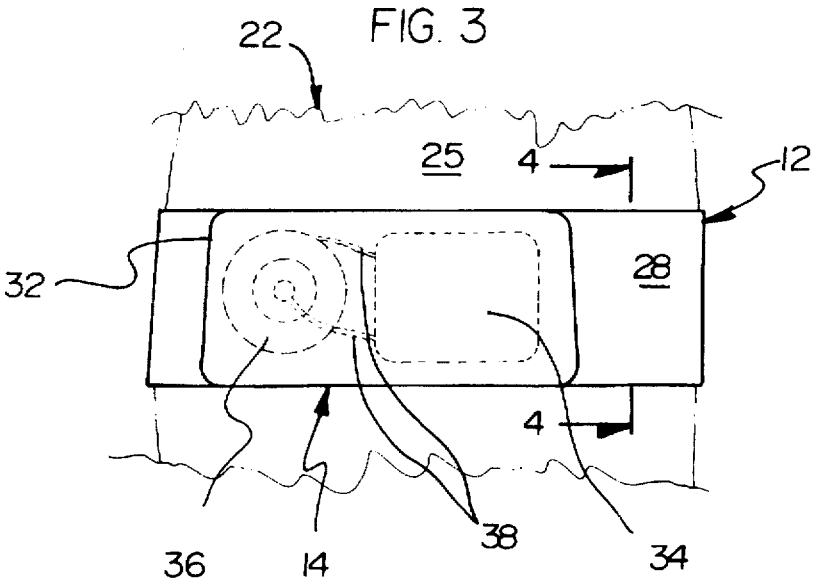
FIG. 3 is an enlarged, partially broken away perspective view of the apparatus illustrating the positioning of the transmitter-receiver unit and power source.

The remote transmitter-receiver assembly 14 includes an outer casing 32, a transmitter-receiver unit 34 and a power source 36. The outer casing 32 is formed in a hollow generally rectangular configuration with rounded edges and a height essentially equal to that of the band. Preferably the power source is a miniature circular battery. The transmitter-receiver unit and power source are operatively coupled to each other by a plurality of wires 38 and positioned within the outer casing. The transmitter-receiver unit includes means to transmit and receive electronic signals. In alternate embodiments of the apparatus the transmitter-receiver can be included in any oral device such a retainer, fixed bridge, removable denture or any oral prosthetic device. Note FIG. 3.

The outer casing is affixed to the outer surface of the orthodontic band 12. In the preferred embodiment the orthodontic band is coupled around a child's deciduous molar tooth 22 with the remote transmitter-receiver assembly positioned adjacent to the buccal surface 25 of the child's molar tooth 22. Note FIG. 3.

The base transmitter-receiver device 16 is formed in a generally rectangular configuration and includes means to transmit and receive electronic signals. The device includes a power source, a transmission button 40, a liquid crystal display screen 42, a speaker 44 and an on/off power switch 46. When the apparatus is activated the liquid crystal display screen indicates the geographic location of the lost child. Note FIG. 5.

In an operative orientation a user depresses the transmission button of the base transmitter-receiver device 16 to activate the remote transmitter-receiver assembly 14. In one embodiment of the apparatus this is accomplished by utilizing a satellite relay. Activation of the remote transmitter-receiver device causes the transmission of electrical signals for receipt by the base transmitter-receiver device. As mentioned above, in one embodiment of the apparatus this is accomplished by utilizing a satellite relay. The base transmitter-receiver device then displays the location of the remote transmitter-receiver assembly to enable a user to locate a lost individual. Note FIGS. 5 and 6.

Figure 7:
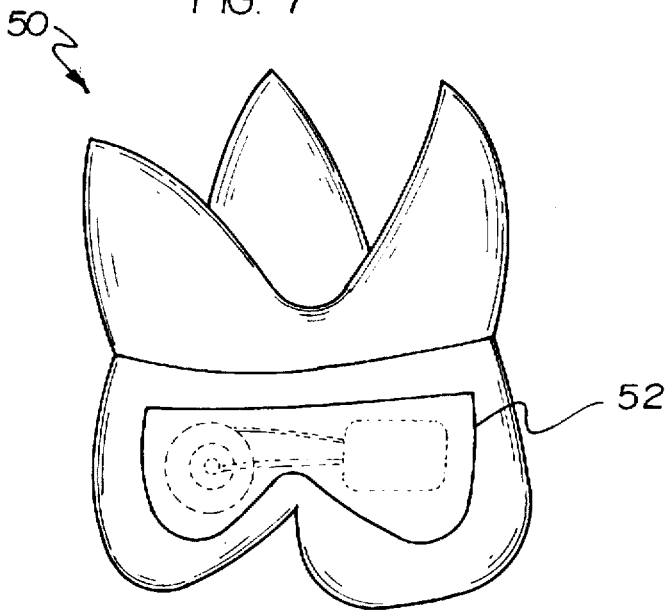
FIGS. 7 and 8 are perspective illustrations of an alternative embodiment of the apparatus illustrating a metal wing and transmitter-receiver secured to a tooth.
Figure 8:
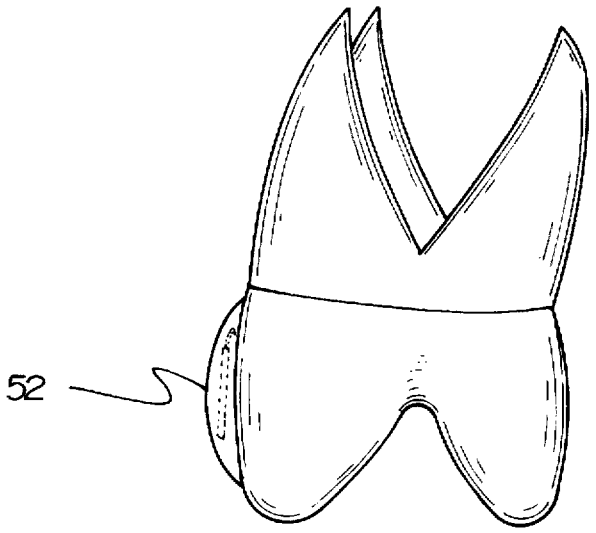

An alternate embodiment 50 of the apparatus is shown in FIG. 7. In such embodiment an orthodontic band is not included with the apparatus. Rather, the transmitter-receiver assembly 14 is affixed to a metal wing 52. The wing is fabricated of non-precious crown and bridge alloy. The metal wing has an inner surface and an outer surface. The metal wing is electrolytically treated. The inner surface includes microetchings and resin cement to permit adherence to the smooth buccal surface of a tooth. Recent advances in adhesive dentistry have developed very strong bonds between metal to composite and composite to tooth enamel. Note FIGS. 7 and 8.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A intra-oral tracking device adapted for use in association with a tooth having a buccal surface and a lingual surface, the apparatus comprising, in combination:

an orthodontic band fabricated of non-precious crown and bridge alloy, the orthodontic band being formed in a ring shaped configuration with an inner surface and an outer surface, the inner surface including adhesive material;

a remote transmitter-receiver assembly including an outer casing, a transmitter-receiver unit and a power source, the outer casing being formed in a hollow generally rectangular configuration, the transmitter-receiver unit and power source being operatively coupled to each other and positioned within the outer casing, the transmitter-receiver unit including means to transmit and receive electronic signals, the outer casing being affixed to the outer surface of the orthodontic band, in an operative orientation the orthodontic band being coupled around a tooth with the remote transmitter-receiver assembly positioned adjacent to the buccal surface of the tooth; and a base transmitter-receiver device formed in a generally rectangular configuration and including means to transmit and receive electronic signals, the device including a power source, a transmission button, a liquid crystal display screen, a speaker and an on/off power switch, in an operative orientation a user depressing the transmission button of the base transmitter-receiver device to activate the remote transmitter-receiver assembly, activation of the remote transmitter-receiver device causing the transmission of electrical signals for receipt by the base transmitter-receiver device, the base transmitter-receiver device thereby displaying the location of the remote transmitter-receiver assembly to enable an adult user to locate a lost individual.

2. An intra-oral tracking device adapted for use in association with a tooth having a buccal surface and a lingual surface, the apparatus comprising:

a tooth mounting member having an inner surface and an outer surface, the inner surface including adhesive material;

a remote transmitter-receiver assembly including means to transmit and receive electronic signals, the transmitter-receiver being affixed to the outer surface of the tooth mounting member, in an operative orientation the tooth mounting member being coupled to a tooth with the remote transmitter-receiver assembly positioned adjacent to the buccal surface of the tooth; and a base transmitter-receiver device including means to transmit and receive electronic signals, the device including a transmission button and a display screen, in an operative orientation a user depressing the transmission button of the base transmitter-receiver device to activate the remote transmitter-receiver, activation of the remote transmitter-receiver device causing the transmission of electrical signals for receipt by the base transmitter-receiver device, the base transmitter-receiver device thereby displaying the location of the remote transmitter-receiver assembly to enable a user to locate a lost individual.

3. The intra-oral tracking device as set forth in claim 2 wherein the tooth mounting member is an orthodontic band, the orthodontic band being formed in a ring shaped configuration and coupled around a tooth in an operative orientation.

4. The intra-oral tracking device as set forth in claim 3 wherein the orthodontic band is fabricated of non-precious crown and bridge alloy.

5. The intra-oral tracking device as set forth in claim 4 wherein the orthodontic band is coupled around a deciduous tooth.

6. The intra-oral tracking device as set forth in claim 2 wherein the tooth mounting member is a metal wing, the metal wing being acid etched to the buccal surface of a tooth.

7. A intra-oral tracking device adapted for use in association with a tooth having a buccal surface and a lingual surface, the apparatus comprising, in combination:

a metal wing fabricated of non-precious crown and bridge alloy, the metal wing having an inner surface and an outer surface, the inner surface including microetchings and resin cement to permit adherence to the buccal surface of a tooth;

a remote transmitter-receiver assembly including an outer casing, a transmitter-receiver unit and a power source, the outer casing being formed in a hollow generally rectangular configuration, the transmitter-receiver unit and power source being operatively coupled to each other and positioned within the outer casing, the transmitter-receiver unit including means to transmit and receive electronic signals, the outer casing being affixed to the outer surface of the metal wing, in an operative orientation the metal wing being coupled to a tooth with the remote transmitter-receiver assembly positioned adjacent to the buccal surface of the tooth; and a base transmitter-receiver device formed in a generally rectangular configuration and including means to transmit and receive electronic signals, the device including a power source, a transmission button, a liquid crystal display screen, a speaker and an on/off power switch, in an operative orientation a user depressing the transmission button of the base transmitter-receiver device to activate the remote transmitter-receiver assembly, activation of the remote transmitter-receiver device causing the transmission of electrical signals for receipt by the base transmitter-receiver device, the base transmitter-receiver device thereby displaying the location of the remote transmitter-receiver assembly to enable a user to locate a lost individual.

* * * * *